US007010812B1

(12) United States Patent
Cho et al.

(10) Patent No.: US 7,010,812 B1
(45) Date of Patent: Mar. 14, 2006

(54) PAPILLA GOWN

(76) Inventors: Ho Soon Michelle Cho, 5217 Northmoor Dr., Dallas, TX (US) 75229; Jaeeun Paek, 583 Seongpo-dong, Yesulin Apt 10-1104 Sangrok-gu, Ansan (KR)

( * ) Notice: Subject to any disclaimer, the term of this patent is extended or adjusted under 35 U.S.C. 154(b) by 0 days.

(21) Appl. No.: 10/922,002

(22) Filed: Aug. 19, 2004

(51) Int. Cl.
*A41D 13/00* (2006.01)

(52) U.S. Cl. ..... 2/114; 2/104

(58) Field of Classification Search ..... 2/114–115, 2/113, 105, 106, 107, 108, 96, 95, 85, 80, 2/83, 79, 69, 88, 104, 94, 249–253; 604/174, 604/179, 345
See application file for complete search history.

(56) References Cited

U.S. PATENT DOCUMENTS 4,280,228 A * 7/1981 Sulzmann ..... 2/104
4,570,268 A * 2/1986 Freeman ..... 2/114
5,305,471 A * 4/1994 Steele et al. ..... 2/102
5,553,323 A * 9/1996 Chou et al. ..... 2/114
5,991,923 A * 11/1999 Maria ..... 2/83
6,460,187 B1 * 10/2002 Siegel ..... 2/114
6,574,800 B1 * 6/2003 Leger et al. ..... 2/114
6,647,552 B1 * 11/2003 Hogan ..... 2/114

* cited by examiner

*Primary Examiner*—Gloria M. Hale
(74) *Attorney, Agent, or Firm*—Park Law Firm; John K. Park

(57) ABSTRACT

A papilla gown includes a cloth web that is adapted to cover the body of a patient, an elongated hole provided on the cloth web communicating the inside of the cloth web with the outside of the cloth web, a pocket attached to the cloth web, a cover portion that is provided on the outside of the cloth web and covers the hole, and a fastener that fastens the cover portion to the outside of the cloth web. The cover portion is an elongated strip that is pivotally attached to the outside of the cloth web. The hole is aligned with the breast nipple of a wearer and the pocket.

13 Claims, 3 Drawing Sheets

PAPILLA GOWN

BACKGROUND OF THE INVENTION

The present invention relates to a papilla gown, which means a breast gown in Latin word. More particularly, this invention relates to a papilla gown that can be comfortably worn by a patient who needs to use a drainage system after a surgery, especially a breast surgery.

Hospital gowns are usually designed to provide basic function as clothing and easy maintenance in relation to cleaning and sterilizing. In addition, it is desirable for hospital gowns to provide an aesthetic appearance and to facilitate easy access to medical attachments to a patient such as a drainage system that should be used by a patient for some time after a surgery.

While there are many hospital gowns by prior art, no hospital gown provided the desirable combination of aesthetic appearance, good accessibility to a drainage system that is required after breast surgery, and ease of wearing. A hospital gown, or a papilla gown that is convenient to use and wear after breast surgery while providing a variety of functions as a gown has long been in need.

SUMMARY OF THE INVENTION

The present invention contrives to solve the disadvantages of the prior art.

An objective of the invention is to provide a papilla gown that provides good accessibility of a drainage system that is required to wear after breast surgery.

Another objective of the invention is to provide a papilla gown that provides function and appearance suitable for a nightgown.

Still another objective of the invention is to provide a papilla gown that facilitates wearing of the drainage system.

Still another objective of the invention is to keep privacy of a patient, when she uses a drainage system.

To achieve the above objectives, the present invention provides a papilla gown that includes a cloth web that is adapted to cover the body of a patient, a hole provided on the cloth web communicating the inside of the cloth web with the outside of the cloth web, a containing portion attached to the cloth web, a cover portion that is provided on the outside of the cloth web and covers the hole, and a fastener that fastens the cover portion to the outside of the cloth web.

The hole has an elongated shape, and the length of the hole is about four inches.

The cover portion includes an elongated strip that is pivotally attached to the outside of the cloth web. The elongated strip is attached to the cloth web longitudinally. The elongated strip has a width of about one inch.

The hole, the containing portion and the cover portion are positioned toward the left side or the right side of the cloth web or both.

The fastener includes a first segment that is attached to the cover portion, and a second segment that is attached on the cloth web. The first segment is engaged with the second segment to fasten the cover portion to the outside of the cloth web. The first segment includes a plurality of hooks and the second segment includes a plurality of loops. The hooks of the first segment engage with the loops of the second segment, and the engaged state is kept by friction.

The first segment includes one or more first fastening elements. The second segment comprises one or more second fastening elements that are positioned alongside the hole. The first fastening elements are positioned to match the second fastening elements when the cover portion is closed.

The containing portion includes a breast shape pocket sewn to the cloth web.

The cloth web includes two raglan sleeves, and the cloth web is front-opening.

The advantages of the present invention are: (1) the papilla gown is suitable to hold and route a drainage system that is required to wear after breast surgery; (2) the papilla gown has aesthetic appearance suitable for an everyday clothing like a nightgown; (3) the papilla gown facilitates wearing of the drainage system; (4) the design of the cover portion and the fastener prevents the tube and reservoir in the pocket from being pulled; and (5) the papilla gown protects privacy of a patient by tightly covering the hole through which the tube passes, and hiding the tube and reservoir in the pocket.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
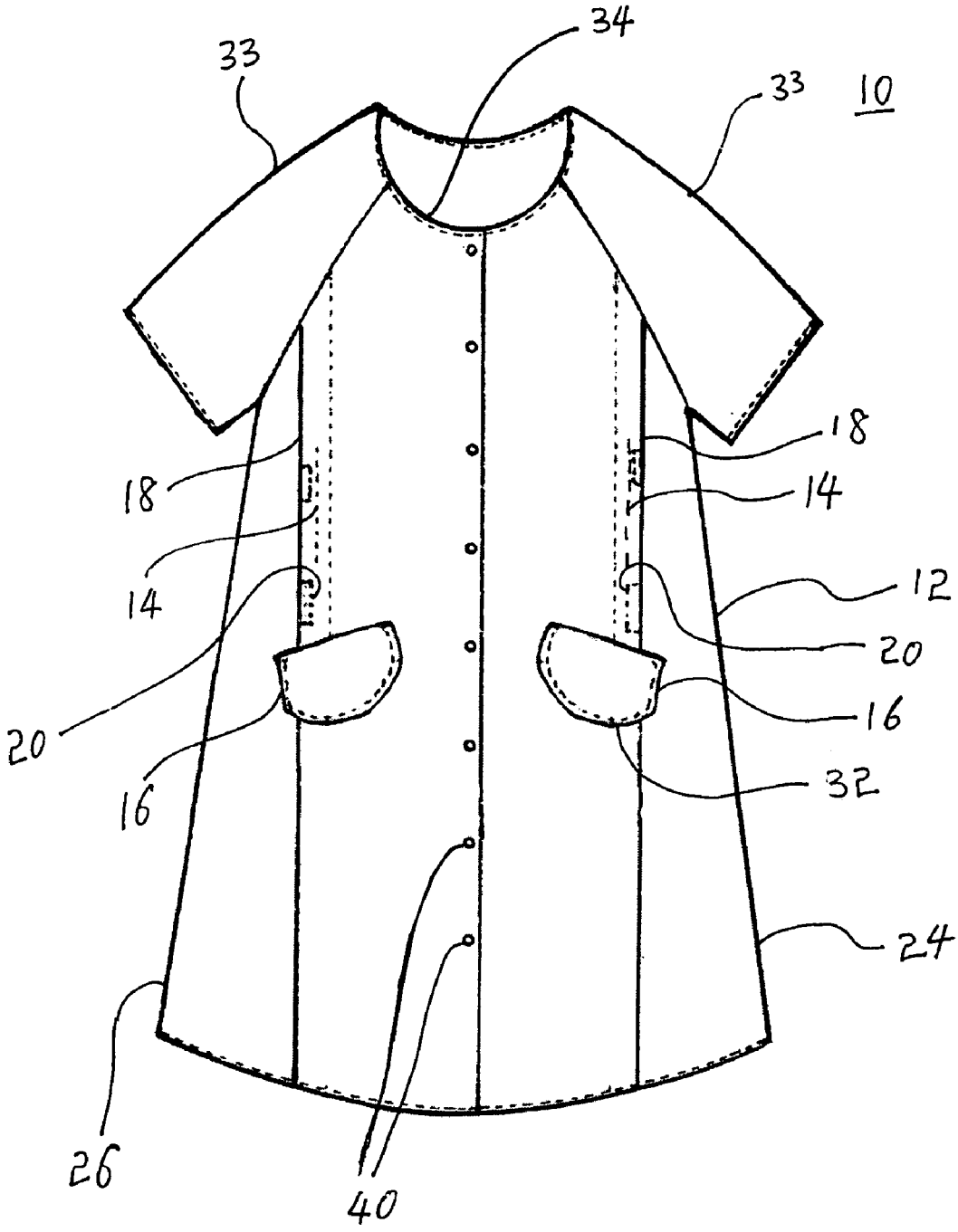
FIG. 1 is a front elevation view showing a papilla gown according to the present invention.
Figure 2:
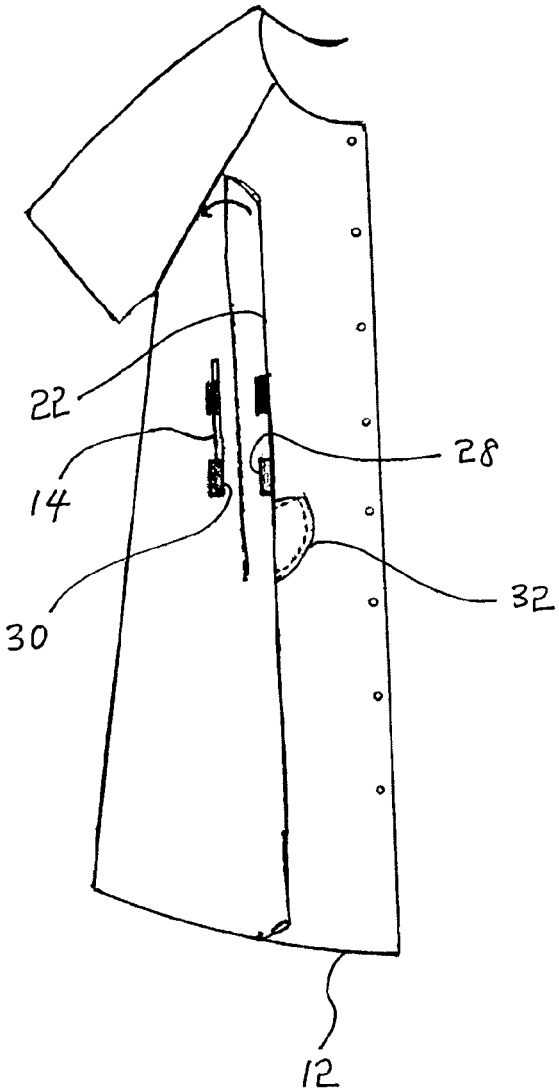
FIG. 2 is a partial front elevation view of the papilla gown showing a cover portion is opened.

FIGS. 1 and 2 show a papilla gown 10 according to the present invention. The papilla gown 10 includes a cloth web 12 that is adapted to cover the body of a patient, two holes 14 provided on the cloth web 12 communicating the inside of the cloth web with the outside of the cloth web 12, two containing portions 16 attached to the cloth web 12, two cover portions 18 that are provided on the outside of the cloth web 12 and cover the holes 14, and two fasteners 20 that fasten the cover portions 18 to the outside of the cloth web 12.

The hole 14 has an elongated shape, and the length of the hole 14 is four inches. The hole 14 is a very narrow slit.

The cover portion 18 includes an elongated strip 22 that is pivotally attached to the outside of the cloth web 12. The elongated strip 22 is attached to the cloth web 12 longitudinally. The elongated strip 22 has a width of one inch.

One set of the hole 14, the containing portion 16, and the cover portion 18 is positioned toward the left side 24 of the cloth web 12, or the left part of the papilla gown 10. The other set of the hole 14, the containing portion 16, and the cover portion 18 is positioned toward the right side 26 of the cloth web 12, or the right part of the papilla gown 10.

The fastener 20 includes a first segment 28 that is attached to the cover portion 18, and a second segment 30 that is attached on the cloth web 12. The first segment 28 is engaged with the second segment 30 to fasten the cover portion 18 to the outside of the cloth web 12. The first segment 28 includes a plurality of hooks (not shown) and the second segment 30 includes a plurality of loops (not shown). The hooks of the first segment 28 engage with the loops of the second segment 30, and the engaged state is kept by friction. VELCRO strips may be used for the hooks of the first segment 28 and the loops of the second segment 30.

The containing portion 16 includes a breast shape pocket 32 sewn to the cloth web 12. The breast shape is commonly defined as a combination of a triangle having dimension of 12×24 cm, and a circle of 24 cm diameter and 9 cm height. The numerical values are approximate.

The cloth web 12 includes two raglan sleeves 33, and the cloth web 12 is front-opening.

Figure 3:
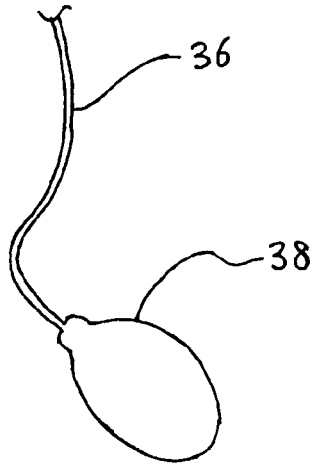
FIG. 3 is a schematic elevation view showing a drainage system including a drainage tube and a reservoir.
Figure 4:
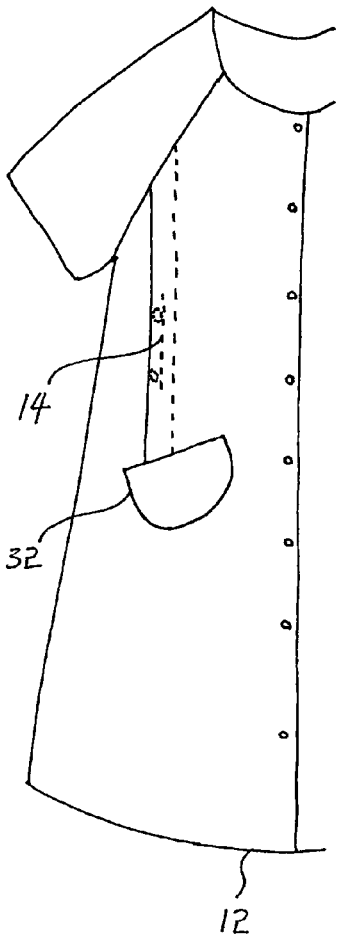
FIG. 4 is a partial front elevation view of the papilla gown showing alternate embodiment of a fastener.
Figure 5:
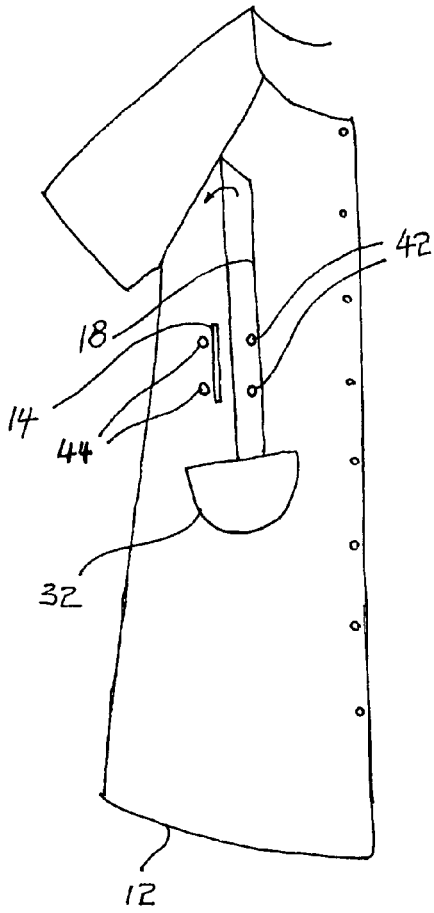
FIG. 5 is a partial front elevation view of the papilla gown showing the fastener is opened.

FIG. 3 shows a drainage system that includes a drain tube 36 and a reservoir 38. Typically, Jackson-Pratt drains and tubes are used as the drainage system. FIGS. 4 and 5 show alternate location of the first segment 28 and the second segment 30. The first segment 28 includes two first fastening elements 42. The second segment 30 includes two second fastening elements 44 that are positioned alongside the hole 14. The first fastening elements 42 are positioned on the cover portion 18 to match and engage with the second fastening elements 44 when the cover portion 18 is closed. The engagement of the first fastening elements and the second fastening elements effectively holds the tube 36 and covers the hole 14 so that part of body of the patient cannot be seen from outside.

The papilla gown 10 is especially suited to be used with "Safety Pouches" carrying Closed (self-contained) Wound Drainage Systems for female breast cancer patients after breast surgeries. The papilla gown 10 is knee-length and made of 100% cotton fabric. The papilla gown 10 may be worn as a nightgown and lounging dress for out patients. The front-opening papilla gown 10 with raglan sleeves 33 and a round neckline 34 incorporates common design features on both, the hospital gown and nightgown. When the Drainage System is not used, the patient can wear the garment as a regular nightgown.

For carrying and securing the Wound Drainage System, the papilla gown 10 has special design features. As shown in FIGS. 1 and 2, the papilla gown 10 has the cover portion or tuck 18 of one-inch size, the four-inch hole or eyelet 14, the first and second segments 28, 30, and the containing portion, or safety pouch 16.

A patient can wear the papilla gown 10 with six easy steps. In step 1, the patient slips into the papilla gown 10 leaving it unbuttoned. In step 2, the patient thread the drain tube 36 and the reservoir 38 from inside the papilla gown 10 through the hole 14. In step 3, the drain tube 36 and the reservoir 38 are passed under the tuck 18. In step 4, the reservoir 38 is put in the safety pouch 16. In step 5, the first segment 28 on the tuck 18 is closed to secure the drainage System in the papilla gown 10 In step 6, snaps 40 on the center front of the papilla gown 10 are closed.

The papilla gown 10 is made with the following steps. In step 1, the hole or eyelet 14 is made. In step 2, the the first and second segments 28, 30 are stitched. In step 3, the tuck 18 is sewn. In step 4, the tuck 18 is folded toward side seam. In step 5, the safety pouch 16 is attached and top stitched.

Referring back to FIG. 1, the hole 14 is provided in a way that the hole 14 is substantially aligned with the pocket 32 and the breast nipple of a wearer of the papilla gown 10 in longitudinal direction of the papilla gown and the hole 14 is provided below the breast nipple and above the pocket 32. Referring back to FIGS. 4 and 5, the elongated strip 22 of the cover portion 18 pivots around a longitudinal pivot axis. The elongated strip 22 covers the hole 14 and extends beyond the hole 14 down to the pocket 32.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A papilla gown comprising:

a) a cloth web that is adapted to cover the body of a patient;

b) an elongated hole provided on the cloth web communicating the inside of the cloth web with the outside of the cloth web;

c) a containing portion attached to the cloth web;

d) a cover portion that is provided on the outside of the cloth web; and e) a fastener that fastens the cover portion to the outside of the cloth web;

wherein the cover portion comprises an elongated strip that is pivotally attached to the outside of the cloth web, wherein the elongated strip is attached to the cloth web longitudinally, wherein the containing portion comprises a pocket attached to the cloth web, wherein the hole is provided in a way that the hole is substantially aligned with the pocket and the breast nipple of a wearer of the papilla gown in longitudinal direction of the papilla gown and the hole is provided below the breast nipple and above the pocket, wherein the elongated strip of the cover portion pivots around a longitudinal pivot axis, wherein the elongated strip covers the hole and extends beyond the hole down to the pocket.

2. The papilla gown of claim 1, wherein the length of the hole is about four (4) inches.

3. The papilla gown of claim 1, wherein the elongated strip has a width of about one (1) inch.

4. The papilla gown of claim 1, wherein the hole, the containing portion and the cover portion are positioned toward the left side or the right side of the cloth web.

5. The papilla gown of claim 1, wherein the fastener comprises a first segment that is attached to the cover portion, and a second segment that is attached on the cloth web, wherein the first segment is engaged with the second segment to fasten the cover portion to the outside of the cloth web.

6. The papilla gown of claim 5, wherein the first segment comprises a plurality of hooks and the second segment comprises a plurality of loops, wherein the hooks of the first segment engage with the loops of the second segment, wherein the engaged state is kept by friction.

7. The papilla gown of claim 5, wherein the first segment comprises one or more first fastening elements, wherein the second segment comprises one or more second fastening elements that are positioned alongside the hole, wherein the first fastening elements are positioned to match the second fastening elements when the cover portion is closed.

8. The papilla gown of claim 1, wherein the cloth web comprises two raglan sleeves.

9. The papilla gown of claim 1, wherein the cloth web is front-opening.

10. The papilla gown of claim 1, wherein the hole and the cover portion are positioned toward the left side or the right side of the cloth web, wherein the fastener comprises a first segment that is attached to the cover portion, and a second segment that is attached on the cloth web, wherein the first segment is engaged with the second segment to fasten the cover portion to the outside of the cloth web, wherein the containing portion comprises a pocket attached to the cloth web.

11. The papilla gown of claim 10, wherein the pocket has a shape that resembles human breast.

12. A papilla gown comprising:

a) a cloth web that is adapted to cover the body of a patient;

b) two holes provided on the cloth web communicating the inside of the cloth web with the outside of the gown;

c) two containing portions attached to the cloth web;

d) two cover portions that are provided on the outside of the cloth web and cover the holes; and e) two fasteners that fasten the cover portions to the outside of the cloth web;

wherein each of the holes has an elongated shape, wherein each of the cover portions comprises an elongated strip that is pivotally attached to the outside of the cloth web, wherein the elongated strip is attached to the cloth web longitudinally, wherein the holes, the containing portions and the cover portions are positioned toward the left side and the right side of the cloth web, wherein each of the fasteners comprises a first segment that is attached to the cover portion, and a second segment that is attached on the cloth web, wherein the first segment is engaged with the second segment to fasten the cover portion to the outside of the cloth web, wherein each of the containing portions comprises a pocket attached to the cloth web, wherein each of the holes is provided in a way that the hole is substantially aligned with the pocket and the breast nipple of a wearer of the papilla gown in longitudinal direction of the papilla gown and the hole is provided below the breast nipple and above the pocket, wherein the elongated strip of each of the cover portions pivots around a longitudinal pivot axis, wherein the elongated strip covers the hole and extends beyond the hole down to the pocket.

13. The papilla gown of claim 12, wherein the pocket has a shape that resembles human breast.

* * * * *